US005668585A

United States Patent [19]

Brechko

[11] Patent Number: 5,668,585

[45] Date of Patent: Sep. 16, 1997

[54] VARIABLE PLATEN PRESSURE CONTROL FOR A THERMAL TRANSFER PRINTER

[75] Inventor: Michael Richard Brechko, Windsor, N.Y.

[73] Assignee: Azon Corp., Johnson City, N.Y.

[21] Appl. No.: 720,766

[22] Filed: Oct. 3, 1996

[51] Int. Cl.[6] ..... B41J 11/20

[52] U.S. Cl. ..... 347/220

[58] Field of Search ..... 347/173, 197, 347/198, 220; 400/120.16, 120.17, 120.02, 55, 58

[56] References Cited

U.S. PATENT DOCUMENTS

| | | | |
|---|---|---|---|
| 4,016,572 | 4/1977 | Hubbard . | |
| 4,055,743 | 10/1977 | Conta et al. . | |
| 4,228,441 | 10/1980 | Rhine . | |
| 4,844,632 | 7/1989 | Minowa . | |
| 4,890,120 | 12/1989 | Sasakai et al. . | |
| 4,949,098 | 8/1990 | Gluck et al. . | |
| 5,206,662 | 4/1993 | Fox et al. . | |
| 5,212,499 | 5/1993 | Hongo et al. | 347/220 |
| 5,328,281 | 7/1994 | Narita et al. . | |
| 5,448,281 | 9/1995 | Walter et al. . | |
| 5,486,057 | 1/1996 | Skinner et al. | 347/173 |
| 5,570,959 | 11/1996 | Moriwaki et al. | 400/58 |

FOREIGN PATENT DOCUMENTS

| | | | |
|---|---|---|---|
| 58-203072 | 11/1983 | Japan | 400/58 |
| 3-138162 | 6/1991 | Japan | 400/58 |

*Primary Examiner*—Huan H. Tran

*Attorney, Agent, or Firm*—Crummy, Del Deo, Dolan, Griffinger & Vecchione

[57] ABSTRACT

A multi-color thermal transfer printer for printing multi-color license plate images on a web of retroflective sheeting material, the printer having a plurality of printing stations. The printer, at each of the printing stations, has a thermal transfer printing head, a printing ribbon having an ink of a pre-selected color, a pivotally-mounted roller platen assembly for pressing a respective one of the printing ribbons and a web of material to be printed upon, against a respective one of the printing heads at a variably selectable pressure to transfer the ink from the ribbon to the web of material. A cylinder device is provided at each of the stations. Each cylinder device is adjustably pressurized by a fluid medium and engaged with a respective one of the roller platen assemblies for the purpose of applying a variably selectable pressure to the pivotally-mounted roller platen assembly in order to control roller platen pressure.

23 Claims, 3 Drawing Sheets

VARIABLE PLATEN PRESSURE CONTROL FOR A THERMAL TRANSFER PRINTER

FIELD OF THE INVENTION

The present invention relates to thermal transfer printers and more specifically, to a thermal transfer printer having variably adjustable roller platen pressure control.

BACKGROUND OF THE INVENTION

Currently available thermal transfer printing heads generally comprise a plurality of thermal elements. The heating elements are generally provided on one side of flat substrate of ceramic or like material along with the requisite electronic circuitry for controlling the activation of the heating elements.

The thermal transfer printing head is typically used in conjunction with a roller platen assembly and an ink transfer printing ribbon which carries a thermally transferred printing ink. During printing, a web of material to be printed and the printing ribbon are oriented between the thermal elements of the printing head and the roller platen of the roller platen assembly such that the printing ribbon is adjacent to the print head and the material to be printed is adjacent to the roller platen. The roller platen and printing head are moved against each other so that the printing ribbon and the material to be printed are pressed against the printing head such that when selected thermal elements of the printing head are heated, ink from the ink transfer printing ribbon is transferred to the material's surface.

Typical thermal transfer printers can include one or more printing heads each of which are capable of printing in a different color. If more than one printing head is employed, the printing heads are generally arranged in line with each other, with each printing head having a roller platen assembly associated therewith.

In order to produce high quality printing, the proper pressure and thermal energy must be applied by the printing head to the material to be printed and ink printing ribbon. The proper printing pressure is dependent upon many factors including the type of printing ribbon used, the material to be printed, and the width and thickness of the printing ribbon and/or material to be printed. For example, the printing pressure requirements for a waxed based printing ribbon are generally different than the printing pressure requirements for a resin based printing ribbon. The printing pressure requirements would also be different for a paper based material to be printed and a material to be printed comprised of vinyl coated retroflective sheeting.

When the transfer printer includes multiple printing heads and the material to be printed being requires the use of less than all the printing heads, the platen rollers must be moved away from the print heads to preserve the printing ribbon. This is typically accomplished by manually inserting some type of block or like means which moves the roller platen assembly away from the printing heads that are not being used in a particular printing job.

The prior art has attempted to address the issue of printing pressure. For example, U.S. Pat. No. 4,228,441, issued to Rhine entitled PRINTER HEAD BIASING APPARATUS, discloses a cantilevered leaf spring arrangement which maintains a constant and preset pressure between the print head and the material to be printed. The cantilevered spring is adjustable to provide the desired amount of pressure between the printing head and the material to be printed.

U.S. Pat. No. 4,844,632 issued to Minowa entitled HEAD BIASING MECHANISM IN A THERMAL PRINTER, discloses an elastic member for moving the printing head toward and away from the platen. The elastic member urges the printing head against the platen at least two levels of biasing force. The Minowa patent also addresses the issue of printing head disengagement by providing a release mechanism for selectively releasing the biasing force on the printing head.

U.S. Pat. No. 4,949,098 issued to Cluck et al. entitled THERMAL PRINTHEAD CONTROLLING MEANS, discloses a printing head controlling structure for disposing the printing head in a non-printing position and for resiliently supporting the printing head in the printing position.

U.S. Pat. No. 5,206,662 issued to Fox et al. entitled METHOD AND APPARATUS FOR ADJUSTING CONTACT PRESSURE OF A THERMAL PRINTHEAD, discloses a spring mechanism for applying a torque against an arm for rotating a shaft to make printhead contact with the printing ribbon and roller platen. The spring mechanism allows the a wide variety of printer media to be accommodated since the pressure between the platen roller an the printing head is variably adjustable.

U.S. Pat. No. 5,328,281 issued to Narita et al. entitled RECORDING MEDIUM FEED MECHANISM FOR A PRINTER AND METHOD OF MEDIUM FEED CONTROL, discloses a printer for an electronic calculator or electronic cash register. The printer disclosed therein employs solenoids for engaging and disengaging contact pressure rollers which permit the separation or disengagement and contacting or engagement with the printing medium.

U.S. Pat. No. 5,448,281 issued to Walter et al. entitled PRINT HEAD PRESSURE ADJUSTING MECHANISM, discloses a printing pressure adjustment system. The adjustment system employs a steel spring for adjusting the pressure of the printing head.

The mechanisms described above still don't offer the precision necessary to optimize printing pressure for various types of printing ribbons and materials to be printed which are available.

The pressure required for closing of the top door is directly related to the pressure applied on the platen. The pressure required for a reflective media could not be implemented without the necessity of a complex latch assembly.

Accordingly, the is a need for a thermal transfer printer which employs a roller platen assembly having a variably adjustable roller platen pressure that can be adjusted in substantially fine increments in order to optimize the printing process for various types of printing ribbons and printing materials.

SUMMARY OF THE INVENTION

In accordance with the present invention, there is provided a thermal transfer printer comprising a thermal transfer printing head, a printing ribbon having an ink of a pre-selected color, a pivotally-mounted roller platen assembly for pressing the printing ribbon and a web of material to be printed upon, against the printing head at a variably selectable pressure to transfer the ink from the ribbon to the web of material. A cylinder device adjustably pressurized by a fluid medium and engaged with the roller platen assembly, applies a variably selectable pressure to the pivotally-mounted roller platen assembly to control the roller platen pressure.

In another embodiment of the present invention, the printer comprises multiple printing stations, each of which includes the print head and pressure controlled roller platen arrangement described above.

DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

Figure 1:
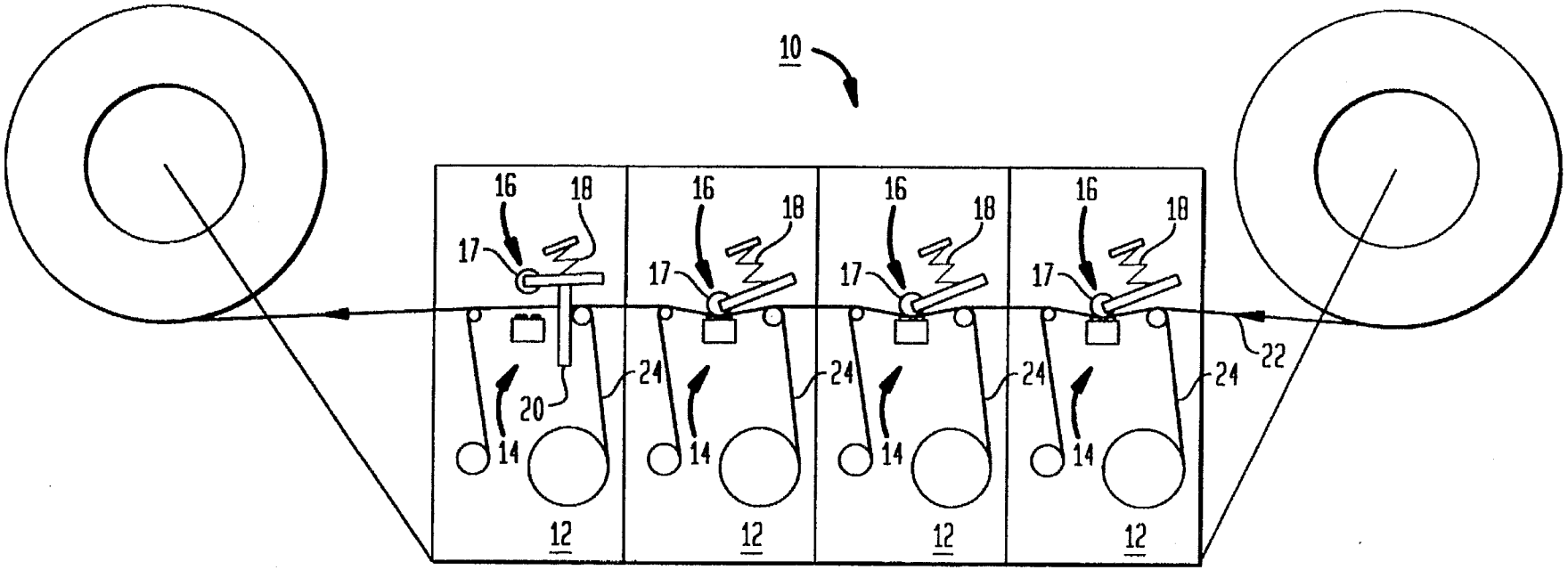
FIG. 1 (PRIOR ART)
FIG. 1 is a schematic view of a typical prior art multi-color thermal transfer printer.

Referring to FIG. 1, a typical prior art multi-color thermal transfer printer 10 is schematically depicted. The printer 10 shown was originally intended for printing onto paper using wax ribbons. However, recent advances have been made in the sign art and especially, in the manufacture of license plates. These advances involve the manufacture of license plates from webs of vinyl coated retroreflective sheeting material, which are first printed with the desired license plate images and then, laminated to rigid substrate material. The printed images can include logos, trademarks, scenes, designs, artworks, and alphanumerics. The use of such images afford the license plates with a personalized character. Moreover, the images can also include one or more machine readable identification codes which allow each of the license plates to be manufactured more efficiently. Further, the identifications codes also function as distribution markers, for automatic toll collection and other similar uses, and allow for subsequent counterfeit protection and license plate verification.

The license plates described above are presently manufactured using the multicolor thermal transfer printer of FIG. 1. Although the printer was specifically designed for printing on paper, the printer 10 is also capable of printing the multi-color logos, trademarks, scenes, designs, artworks, alphanumerics, and ID codes onto the unprinted webs of vinyl coated retroreflective sheeting material.

The printer 10 includes a series of essentially identical in line printing stations 12 for printing onto an unprinted web 22 of vinyl coated retroreflective sheeting material. Each of the printing stations 12 has a thermal printing head 14, a pivotally-mounted roller platen assembly 16 which includes a roller platen 17, and a resin-based printing ribbon 24 of a pre-selected color. In order to maintain the appropriate amount of printing pressure, each roller platen assembly 16 is coupled to a coil-like spring 18 which presses the roller platen 17 of the roller platen assembly 16 against the printing ribbon 24 and the web 22 of retroreflective sheeting material, thereby forcing the printing ribbon 24 and the web 22 of retroflective sheeting material against the printing head 14. Since the retroreflective sheeting material used for printing license plates requires substantially higher roller platen pressure than the paper medium that the printer 10 was designed to print upon, higher rate coil springs are employed.

The use of the higher rate coil springs causes problems with the top door closure. A further problem inherent in the design of the printer 10 involves the method for adjusting the roller platen pressure. More specifically, when the roller platen pressure needs to be adjusted in order to compensate for the type of printing ribbon used, the type of sheeting material being printed upon, etc., the coil springs 18 must be removed and replaced with a different set of coil springs having a different spring rate. Accordingly, many different sets of coil springs of differing spring rates must be maintained in order to allow for fine adjustments in roller platen pressure. Further, determining which spring set is appropriate for a given type of sheeting material, printing ribbon, etc., is a hit and miss process which requires costly printer down time. Additionally, the coil springs can fatigue and thus, exhibit a lower spring rate which lowers the roller platen pressure and detrimentally effects the printing process.

Another problem inherent in the design of printer 10 involves the method for deactivating one or more of the printing stations 12. This is presently accomplish by a block device 20 which is manually inserted under the roller platen assembly 16 to lift the roller platen 17 away from the printing head 14 when the image being printed on the web 22 of retroflective sheeting material, requires the use of less than all the printing stations 12.

Figure 2:
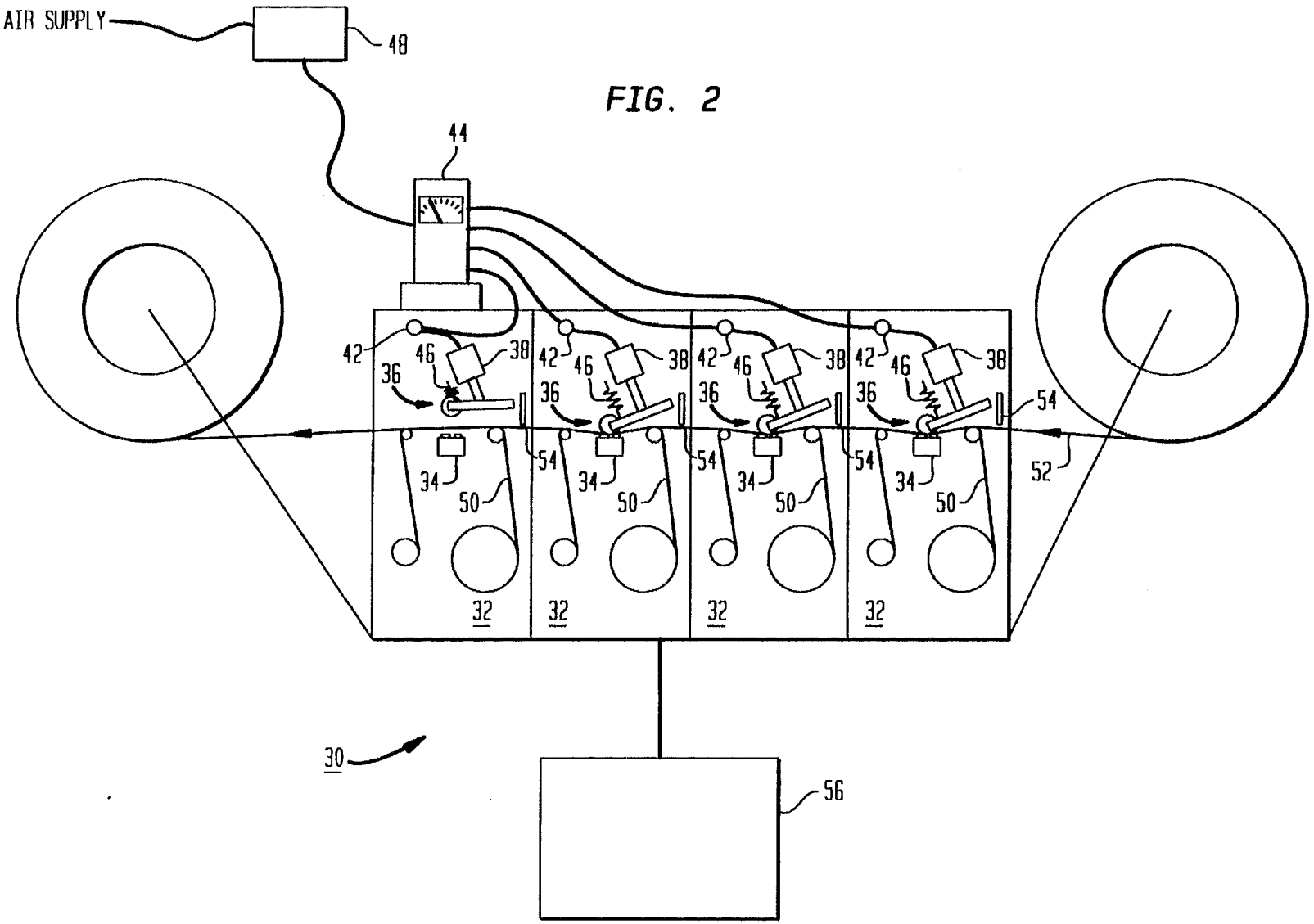
FIG. 2 is a schematic view of the multi-color thermal transfer printer according to the present invention.

Referring to FIG. 2, there is shown an embodiment of a multi-color thermal transfer printer 30 according to the present invention. The printer 30 is somewhat similar to the printer 10 of FIG. 1 in that it includes a series of essentially identical in line printing stations 32 for printing onto an unprinted web 52 of vinyl coated retroreflective sheeting material. Each printing station 32 employs a thermal printing head 34, a pivotally-mounted roller platen assembly 36 and a resin-based printing ribbon 50 of a pre-selected color. However, the printer 30 of the present invention doesn't employ the prior art's coil spring arrangement for roller platen pressure control. Instead, each printing station 32 of the printer 30 of the present invention comprises a cylinder device 38 which is pressurized by a fluid medium. The cylinder device 38 applies a constant, finely adjustable force to the roller platen assembly 36, for controlling the roller platen pressure and thus, ensures the proper transfer of ink from the printing ribbon 50 to the web 52 of retroreflective sheeting material. As will be explained, the pressurized cylinder devices 38 can be selectively activated and deactivated as needed for a given license plate image.

In a preferred embodiment of the present invention, the fluid medium used for pressurizing the cylinder devices 38 is a compressible, gas such as air. Accordingly, the pressurized cylinder devices 38 comprise conventional pneumatically pressurized cylinders 38. Each pneumatically pressurized cylinder 38 includes a piston 78 (FIGS. 4A and 4B) which applies a variably adjustable force to an associated roller platen assembly 36 in accordance with the air pressure at the cylinders 38. In other embodiments of the present invention, the fluid medium used for pressurizing the cylinder devices 38 comprise a substantially non-compressible fluid such as oil. Accordingly, in these embodiments, hydraulically pressurized cylinders or the like are employed in place of the pneumatically pressurized cylinders 38.

In any case, all the pressurized cylinders 38 are coupled to a mechanical or electrically controlled fluid pressure regulator 44 that allows for very fine adjustments of the fluid medium pressure supplied to the pressurized cylinders 38 to variably adjust and maintain proper roller platen pressure. When pneumatically pressurized cylinders are employed, the pressure regulator 44 comprises a conventional air pressure regulator. Accordingly, optimal roller platen pressures for printing can be easily be determined during process development by simply adjusting the air pressure of the pneumatically pressurized cylinders 38 via the air pressure regulator 44. In addition, the pneumatically controlled roller platen pressures can be easily maintained during regular production since, simple air pressure adjustments can be made for proper ink transfer with lot to lot variations in printing ribbons, reflective sheeting or when printing ribbon and reflective sheeting vendors are changed.

Referring still to FIG. 2, an electrically activated fluid medium control valve 42 is coupled between each of the pressurized cylinders 38 and the pressure regulator 44. When pneumatically pressurized cylinders are employed, the control valve 42 comprises a conventional air control valve. The electrically activated air control valves 42 allow their respective pneumatic cylinders 38 to be selectively deactivated when a particular license plate image requires less than all the printing stations 32. A roller platen return spring 46 is provided for moving the deactivated roller platen assembly 36 away from the printing head 34 when the printing station 32 is not in use. This would be desirable for example, in the situation where the license plate image being printed is only 2 or 3 colors, and thus, requires less than all the printing stations 32. This automatic feature eliminates the use of the manually inserted block devices of the prior art.

In order to allow all the pressurized cylinder devices 38 to be simultaneously deactivated without having to shut down the fluid medium supply or change the fluid medium pressure regulator setting, the present invention provides an electrically activated main fluid medium control valve 48 coupled between the fluid medium supply 49 and the fluid medium pressure regulator 44. When pneumatically pressurized cylinders are employed, the main fluid medium control valve 48 comprises a main air control valve.

It should be understood, that when hydraulically pressurized cylinders or the like are employed, the fluid medium pressure regulator, the fluid medium control valves, and the main fluid medium control valve are appropriately selected for use with a hydraulic fluid medium such as oil. Such hydraulic components are well known in the art.

The air pressure regulator 44, the electrically activated air control valves 42 and the electrically activated main air control valve 46 are all coupled to a process control computer 56. The process control computer 56 includes a database which stores information about the printing ribbon, the printing medium, image, etc., and uses this information to automatically select the appropriate pneumatic cylinders 38 and pneumatic cylinder control pressure via the air pressure regulator 44 and the electrically activated air control valves 42 and 48. This can be also applied to each print station. If desired, the process control computer 56 can be used to manually by an operator, to select the pneumatic cylinders 38 and control the air pressure via the air pressure regulator 44 and the electrically activated air control valves 42 and 48. In an alternate embodiment the air control valves 42 and 48 can be manually actuated. If during the printing process, a problem occurs, the computer 56 can automatically deactivate all the pneumatic cylinders 38 via the main air control valve 48, to stop the process until the problem can be corrected.

In an enhancement to the present invention, each license plate image may include at least one machine readable identification code (bar code) or, the bar codes may be preprinted on the vinyl coated retroreflective sheeting material 52. The bar codes can be scanned by an optical scanner to gain access to a database in the process control computer 56 which stores information about the image to be printed on the license plates by the printer of the present invention. When the bar codes are preprinted on the sheeting material 52, additional automatic control over the printing process can be had by providing an optical scanner 54 for reading the preprinted identification codes at each printing station 32. In such an embodiment of the present invention, the optical scanners 54 are also coupled to the process control computer 56 along with the air pressure regulator 44, the electrically activated air control valves 42 and the electrically activated main air control valve 48. As the sheeting material enters each printing station, the optical scanner 54 reads the identification code and signals the computer to select the appropriate pneumatic cylinders 38 and pneumatic cylinder control pressure via the air pressure regulator 44 and the electrically activated air control valves 42 based on the image information stored in the database of the process control computer 56.

Figure 3:
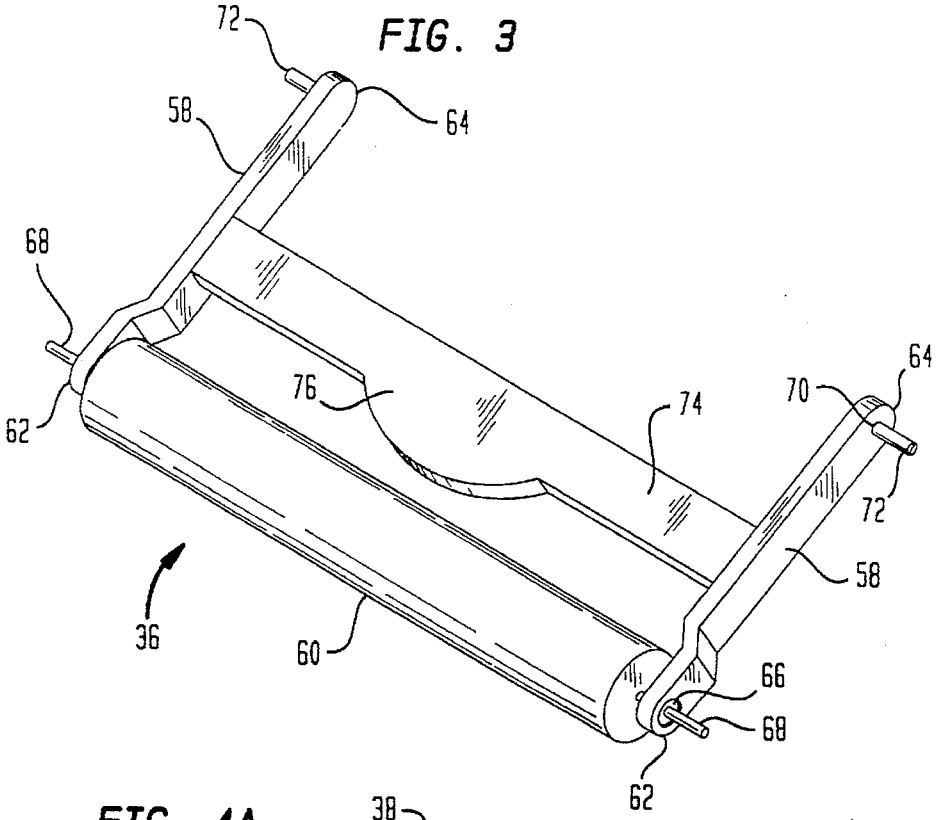
FIG. 3 is perspective view of the platen assembly.

Referring to FIG. 3, there is shown an embodiment of one of the pivoting roller platen assemblies 36 employed in the present invention. The pivoting roller platen assembly 36 generally includes a pair of parallel spaced linkage arms 58 which rotatively retain a cylindrically-shaped rubber roller platen 60 which extends there between. Each linkage arm 58 includes a first end 62 and a second end 64. The first end 62 of each linkage arm 58 has a bushing 66 installed therein for receiving a spindle 68 extending from each end of the roller platen 60. The second end 64 of each linkage arm 58 defines an aperture 70 for receiving a set screw pivot pin 72. A plate member 74 extends between the linkage arms 58 immediately adjacent to the roller platen 60 and includes an enlarged section 76 which is engaged by the piston 78 of a respective pressurized cylinder 38.

Figure 4A:
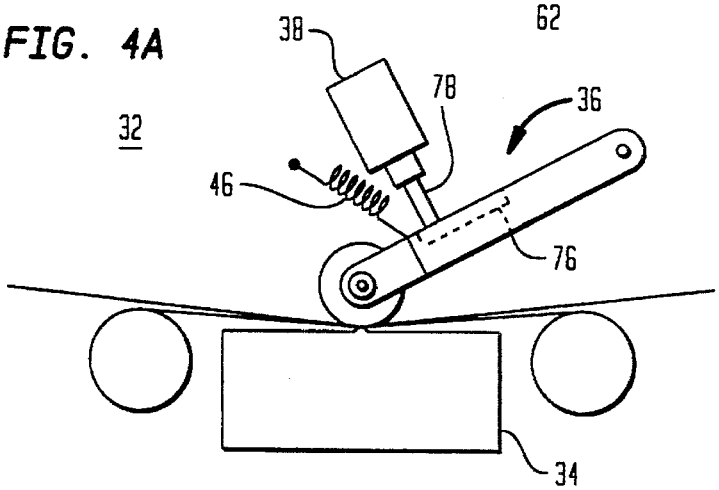
FIG. 4A illustrates how the pressurized cylinder devices control roller platen pressure.
Figure 4B:
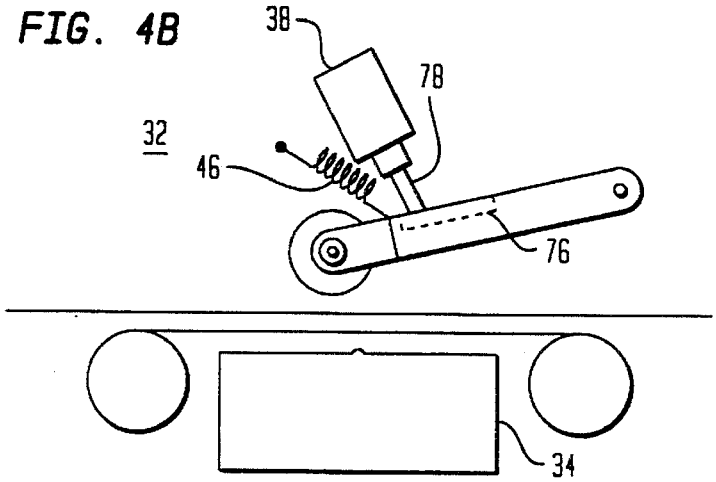
FIG. 4B illustrates how the pressurized cylinder devices are used to deactivate a printing station.

FIG. 4A illustrates how the pressurized cylinder 38 controls roller platen pressure. As shown, the pressurized cylinder device 38 is mounted above the roller platen assembly 36 so that the piston 78 of the cylinder device 38 engages the enlarged plate section 76 of the roller platen assembly 36. As the air pressure is increased or decreased to the cylinder device 38, the piston 78 applies more or less pressure respectively, to the roller platen assembly 36 via the enlarged plate section 76 accordingly, increasing or decreasing the roller platen pressure. When air pressure is completely removed from the cylinder device 38, the roller platen return spring 46 pivots the roller platen assembly 36 up and away from the printing head 34 which forces the piston 78 into the cylinder device 38 as shown in FIG. 4B, and thus, deactivates the printing station. Alternatively, the roller platen return spring 46 may be omitted, as the media path will raise the roller platen assembly 36 up and away from the printing head 34.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claims is reserved.

What is claimed:

1. A thermal transfer printer comprising:

a thermal transfer printing head;

a printing ribbon having an ink of a pre-selected color;

a pivotally-mounted roller platen assembly for pressing said printing ribbon and a web of material to be printed upon, against said printing head at a variably selectable pressure to transfer said ink from said ribbon to the web of material; and a cylinder device adjustably pressurized by a fluid medium, engaged with said roller platen assembly for applying said variably selectable pressure to said pivotally-mounted roller platen assembly.

2. The printer as recited in claim 1, wherein said fluid medium comprises a compressible fluid.

3. The printer as recited in claim 1, wherein said fluid medium comprises a substantially non-compressible fluid.

4. The printer as recited in claim 1, further comprising a selectively adjustable fluid medium pressure regulator coupled between said cylinder device and a fluid medium source which supplies said fluid medium at a constant pressure, said pressure regulator for selectively adjusting the pressurizing of said cylinder device with said fluid medium.

5. The printer as recited in claim 4, further comprising an electrically activated control valve coupled between said pressure regulator and said cylinder device, for selectively deactivating said cylinder device by stopping the flow of said fluid medium to said cylinder device without adjusting the setting of said pressure regulator.

6. The printer as recited in claim 5, further comprising a roller platen assembly return spring for pivotally moving said roller platen assembly away from said printing head when said cylinder is deactivated.

7. The printer as recited in claim 1, wherein said roller platen assembly includes a pair of spaced apart linkage arms which rotatively retain a roller platen extending there between.

8. The printer as recited in claim 7, wherein said roller platen assembly includes a plate member coupled between said linkage arms immediately adjacent to said roller platen, said plate member including an enlarged section which is engaged by said cylinder device.

9. A multi-color thermal transfer printer having a plurality of printing stations, said printer comprising:

a thermal transfer printing head at each of said printing stations;

a printing ribbon having an ink of a pre-selected color at each of said printing stations;

a pivotally-mounted roller platen assembly at each of said stations for pressing a respective one of said printing ribbons and a web of material to be primed upon, against a respective one of said printing heads at a variably selectable pressure to transfer said ink from said respective one of said ribbons to the web of material; and a cylinder device at each of said stations, said cylinder device adjustably pressurized by a fluid medium and engaged with a respective one of said roller platen assemblies for applying said variably selectable pressure to said respective one of said pivotally-mounted roller platen assemblies.

10. The printer as recited in claim 9, wherein said fluid medium comprises a compressible fluid.

11. The printer as recited in claim 9, wherein said fluid medium comprises a substantially non-compressible fluid.

12. The printer as recited in claim 9, further comprising a selectively adjustable fluid medium pressure regulator coupled between all of said cylinder devices and a fluid medium source which supplies said fluid medium at a constant pressure, said pressure regulator for selectively adjusting the pressurizing of said cylinder devices with said fluid medium.

13. The printer as recited in claim 12, further comprising an electrically activated control valve coupled between said pressure regulator and each of said cylinder devices, for selectively deactivating at least one of said cylinder devices when less than all of said printing stations are required, by stopping the flow of said fluid medium to said at least one of said cylinder devices without adjusting the setting of said pressure regulator.

14. The printer as recited in claim 13, further comprising:

a computer having a database which stores information about images to be printed on the web of material to be printed upon, coupled to said pressure regulator and all of said control valves for automatically adjusting the pressure applied by said roller platen assemblies; and a scanner at each of said printing stations for reading identification codes printed on the web of material to be printed upon, wherein each of said identification codes are scanned by said scanner to gain access to said database in order to provide automatic control over the printing process, whereby as the web of material to be printed upon enters each of said printing stations, said scanner reads the identification code and signals said computer to select appropriate ones of said cylinder devices via said control valves and adjust the setting of said pressure regulator.

15. The printer as recited in claim 14, further comprising an electrically activated main control valve coupled between said fluid medium source and said pressure regulator for enabling all of said cylinder devices to be simultaneously deactivated without having to shut down the fluid medium source and change the pressure regulator setting.

16. The printer as recited in claim 13, further comprising a roller platen assembly return spring at each of said printing stations for pivotally moving a respective one of said roller platen assemblies away from an associated one of said printing heads when a respective one of said cylinder devices is deactivated.

17. The printer as recited in claim 9, wherein each of said roller platen assemblies includes a pair of spaced apart linkage arms which rotatively retain a roller platen which extends there between.

18. The printer as recited in claim 17, wherein each of said roller platen assemblies includes a plate member coupled between said linkage arms immediately adjacent to said roller platen, said plate member including an enlarged section engaged by said cylinder device.

19. A multi-color thermal transfer printer for printing multi-color license plate images on a web of retroflective sheeting material, said printer having a plurality of printing stations, said printer comprising:

a thermal transfer printing head at each of said printing stations;

a printing ribbon having an ink of a pre-selected color at each of said printing stations;

a pivotally-mounted roller platen assembly at each of said stations for pressing a respective one of said printing ribbons and a web of material to be printed upon, against a respective one of said printing heads at a variably selectable pressure to transfer said ink from said respective one of said ribbons to the web of material; and a cylinder device at each of said stations, said cylinder device adjustably pressurized by a fluid medium and engaged with a respective one of said roller platen assemblies for applying said variably selectable pressure to said respective one of said pivotally-mounted roller platen assemblies.

20. The printer as recited in claim 19, wherein each of said cylinder devices comprises a pneumatic cylinder and said fluid medium comprises air.

21. The printer as recited in claim 20, further comprising a selectively adjustable air pressure regulator coupled between all of said cylinder devices and an air source which supplies said air at a constant pressure, said pressure regulator for selectively adjusting the pressurizing of said pneumatic cylinder devices with said air.

22. The printer as recited in claim 21, further comprising an electrically activated air control valve coupled between said pressure regulator and each of said pneumatic cylinder devices, for selectively deactivating at least one of said pneumatic cylinder devices when less than all of said printing stations are required, by stopping the flow of said air to said at least one of said pneumatic cylinder devices without adjusting the setting of said pressure regulator.

23. The printer as recited in claim 22, further comprising an electrically activated main air control valve coupled between said air source and said pressure regulator for enabling all of said pneumatic cylinder devices to be simultaneously deactivated without having to shut down the air source and change the pressure regulator setting.

* * * * *